US012774836B2

(12) United States Patent
Ha et al.

(10) Patent No.: US 12,774,836 B2
(45) Date of Patent: Oct. 27, 2026

(54) HEAT SUPPLY APPARATUS AND METHOD FOR CONTROLLING THEREOF

(71) Applicant: LG ELECTRONICS INC., Seoul (KR)

(72) Inventors: Doyong Ha, Seoul (KR); Jeongseob Shin, Seoul (KR); Seungtaek Oh, Seoul (KR); Hyunjong Kim, Seoul (KR); Kyongmin Kwon, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 120 days.

(21) Appl. No.: 18/775,859

(22) Filed: Jul. 17, 2024

(65) Prior Publication Data

US 2025/0027678 A1 Jan. 23, 2025

(30) Foreign Application Priority Data

Jul. 19, 2023 (KR) ..... 10-2023-0093544

(51) Int. Cl.
*F25B 41/385* (2021.01)
*F25B 41/325* (2021.01)

(52) U.S. Cl.
CPC ..... *F25B 41/325* (2021.01); *F25B 41/385* (2021.01); *F25B 2339/047* (2013.01); *F25B 2500/26* (2013.01); *F25B 2600/2513* (2013.01)

(58) Field of Classification Search
CPC .... F25B 25/005; F25B 41/325; F25B 41/385; F25B 2339/047; F25B 2500/26;
(Continued)

(56) References Cited

U.S. PATENT DOCUMENTS 4,606,198 A * 8/1986 Latshaw ..... F25B 41/385 62/205
5,357,766 A * 10/1994 Shiraishi ..... F24F 1/0003 62/197

(Continued)

FOREIGN PATENT DOCUMENTS

CN 212746959 3/2021
EP 1162419 12/2001

(Continued)

OTHER PUBLICATIONS

KR 10-2878609 (English translation) (Year: 2023).*

(Continued)

*Primary Examiner* — Jonathan Bradford
(74) *Attorney, Agent, or Firm* — KED & ASSOCIATES, LLP

(57) ABSTRACT

A heat supply apparatus includes a compressor compressing refrigerant; a first heat exchanger being connected to the compressor through a refrigerant pipe and exchanging heat between refrigerant and water; a second heat exchanger being connected to the compressor through a refrigerant pipe and exchanging heat between refrigerant and air; a first expansion device disposed in a refrigerant pipe connecting the first heat exchanger and the second heat exchanger; a second expansion device connected to the first expansion device in parallel and opened and closed according to an electrical signal; and a controller controlling the degree of opening of the second expansion device, wherein, if heating operation is started, and temperature of water flowing into the first heat exchanger is higher than temperature of refrigerant flowing into the first heat exchanger, the controller opens the second expansion device.

20 Claims, 11 Drawing Sheets

(58) Field of Classification Search
CPC .... F25B 2600/2513; F25B 2700/21161; F25B 2700/21162
See application file for complete search history.

(56) References Cited

U.S. PATENT DOCUMENTS

| | | | | |
|---|---|---|---|---|
| 2006/0162377 | A1* | 7/2006 | Collings | F25B 41/39 62/527 |
| 2008/0202140 | A1* | 8/2008 | Sienel | F25B 9/008 62/513 |
| 2008/0289346 | A1* | 11/2008 | Gernemann | F25B 41/347 251/129.01 |
| 2013/0111929 | A1* | 5/2013 | Jekimow | F25B 41/34 62/56 |
| 2018/0252449 | A1* | 9/2018 | Ito | F25B 41/20 |
| 2019/0086124 | A1* | 3/2019 | Liu | F25B 41/00 |

FOREIGN PATENT DOCUMENTS

| | | |
|---|---|---|
| EP | 3040648 | 7/2016 |
| EP | 3147622 | 9/2018 |
| EP | 2940407 | 11/2018 |
| EP | 3431896 | 11/2019 |
| EP | 3751211 | 3/2023 |
| JP | 2002-206805 | 7/2002 |
| JP | 6537703 | 7/2019 |
| KR | 10-1998-0085211 | 12/1998 |
| KR | 10-1999-0042524 | 6/1999 |
| KR | 10-2000-0055613 | 9/2000 |
| KR | 10-2018-0118397 | 10/2018 |
| KR | 10-2022-0001156 | 1/2022 |
| KR | 10-2022-0027562 | 3/2022 |
| KR | 10-2023-0093901 | 6/2023 |
| WO | WO 2022/014450 | 1/2022 |

OTHER PUBLICATIONS

U.S. Appl. No. 18/775,444, filed Jul. 17, 2024.
U.S. Appl. No. 18/775,618, filed Jul. 17, 2024.
U.S. Appl. No. 18/775,751, filed Jul. 17, 2024.
U.S. Appl. No. 18/775,859, filed Jul. 17, 2024.
Extended European Search Report dated Oct. 16, 2024 issued in Application No. 24189096.1.
Korean Office Action dated Dec. 2, 2025 issued in Application No. 10-2023-0093544.
European Search Report dated Dec. 16, 2024, issued in Application No. 24189100.1.
Korean Notice of Allowance dated Jul. 31, 2026 issued in Application No. 10-2023-0093544.

* cited by examiner

HEAT SUPPLY APPARATUS AND METHOD FOR CONTROLLING THEREOF

CROSS-REFERENCE TO RELATED APPLICATION(S)

This application claims priority under 35 U.S.C. § 119 to Korean Application No. 10-2023-0093544 filed in Korea on Jul. 19, 2023, whose entire disclosure is hereby incorporated by reference.

BACKGROUND

1. Field

The present disclosure relates to a heat supply apparatus and more specifically, to a heat supply apparatus that exchanges heat between water and refrigerant.

2. Background

A heating system including a boiler may burn a carbon-based fuel to heat water or other liquid and may circulate the heated water to supply the heat from the boiler to a load, such as radiators, underfloor heating, or a hot water tank, through pipes connecting the boiler to the load. The pipes connecting the boiler and the load may be disposed within a building. However, many regions, such as certain European countries, are replacing boilers with heat supply apparatuses that utilize a heat exchange between water and a refrigerant to reduce carbon emissions and to minimize the use of the refrigerant.

An example, of a 'heat exchanger' is disclosed in the Korean patent laid-open publication No. 10-2022-0027562, and this heat exchanger comprises a compressor; a four-way value; a first heat exchanger exchanging heat between water and refrigerant; a second heat exchanger exchanging heat between outdoor air and refrigerant; and an expansion valve disposed between the first and second heat exchangers. The above reference is incorporated by reference herein where appropriate for appropriate teachings of additional or alternative details, features and/or technical background.

In this and other conventional heat exchangers, a temperature of water flowing into the first heat exchanger during the initial stage of a heating operation tends to be higher than the temperature of refrigerant discharged from the compressor and flowing into the first heat exchanger, which may cause the refrigerant to not condense properly as it passes through the first heat exchanger. In particular, since an Air to Water Heat Pump (AWHP), which exchanges heat between water and refrigerant and cools down or warms up the indoor space using the heat exchanged water, may increase the temperature of water flowing through the first heat exchanger to more than 60 degrees Celsius, it may take much longer for the temperature of the refrigerant flowing into the first heat exchange to become lower than the temperature of water flowing into the first heat exchanger.

If the temperature of the water flowing into the first heat exchanger is higher than the temperature of the refrigerant flowing into the first heat exchanger, the refrigerant may not be fully condensed while passing through the first heat exchanger, and thus, and the refrigerant may move from the first heat exchanger and to an expansion valve in a gaseous state. Since it may be difficult for gaseous refrigerant to pass smoothly through the expansion valve, the pressure of a low-pressure section may further decrease across the entire cycle, potentially leading to a compressor failure.

BRIEF DESCRIPTION OF THE DRAWINGS

Embodiments will be described in detail with reference to the following drawings in which like reference numerals refer to like elements, and wherein.

DETAILED DESCRIPTION

In what follows, embodiments disclosed in this document will be described in detail with reference to appended drawings. The same or similar constituting elements are given the same reference number irrespective of their drawing symbols, and repeated descriptions thereof will be omitted. The suffixes "module" and "unit" for the constituting elements used in the following descriptions are assigned or used interchangeably only for the convenience of writing the present document and do not have separate meanings or roles distinguished from each other.

Also, in describing an embodiment disclosed in the present document, if it is determined that a detailed description of a related art incorporated herein unnecessarily obscures the gist of the embodiment, the detailed description thereof will be omitted. Also, it should be understood that the appended drawings are intended only to help understand embodiments disclosed in the present document and do not limit the technical principles and scope; rather, it should be understood that the appended drawings include all of the modifications, equivalents, or substitutes belonging to the technical principles and scope.

Also, terms including an ordinal number such as first or second may be used to describe various constituting elements, but the constituting elements should not be limited by these terms. Those terms are used only for the purpose of distinguishing one constituting element from the others.

If a constituting element is said to be "connected" or "attached" to other constituting element, the former may be connected or attached directly to the other constituting element, but there may be a case in which another constituting element is present between the two constituting elements. On the other hand, if a constituting element is said to be "directly connected" or "directly attached" to other constituting element, it should be understood that there is no other constituting element between the two constituting elements. A singular expression should be understood to indicate a plural expression unless otherwise explicitly stated.

In the present disclosure, the term "include" or "have" is used to indicate existence of an embodied feature, number, step, operation, constituting element, component, or a combination thereof; and should not be understood to preclude the existence or possibility of adding one or more other features, numbers, steps, operations, constituting elements, components, or a combination thereof.

The direction indications of up (U), down (D), left (Le), right (Ri), front (F), and rear (R) shown in the accompanying drawings are introduced only for the convenience of description, and it should be understood that the technical principles disclosed in the present disclosure are not limited by the indications.

Figure 1:
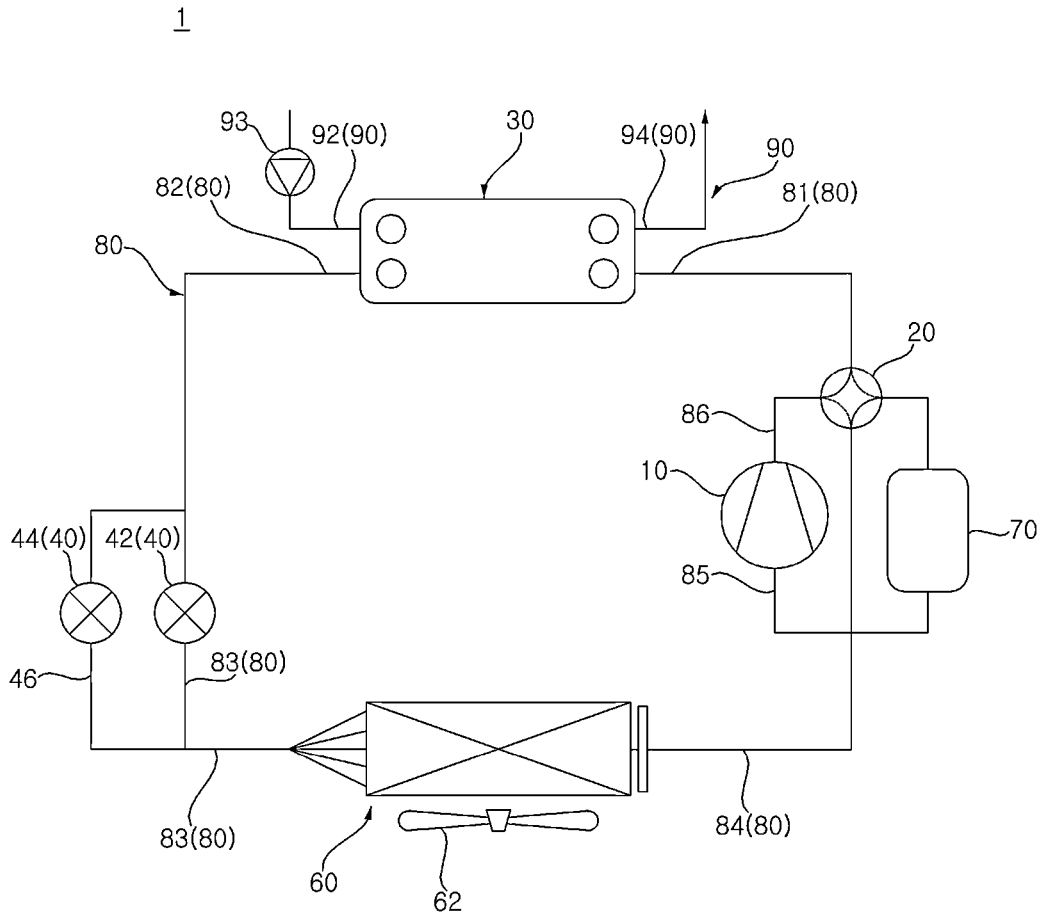
FIG. 1 is a schematic diagram of a heat supply apparatus according to one embodiment.

Referring to FIG. 1, the heat supply apparatus 1 may comprise a compressor 10 compressing refrigerant, a first heat exchanger 30 exchanging heat between refrigerant and water, a second heat exchanger 60 exchanging heat between refrigerant and air, and an expansion device 40 disposed between the first heat exchanger 30 and the second heat exchanger 60.

The heat supply apparatus 1 may be an Air to Water Heat Pump (AWHP) that exchanges heat between water and refrigerant. The AWHP may warm up the indoor space or supply hot water by using the heat energy from the outdoor air to warm up the water circulating the indoor space. Through this process, the AWHP may be used for heating and to generate hot water in cold climates. Conversely, AWHP may transfer the heat energy in the indoor space to the refrigerant circulating the outdoor unit through water circulating in the indoor space, and the refrigerant may discharge the heat energy transferred to an outdoor space. Through the above process, AWHP may also cool down indoor spaces or generate cold water.

The compressor 10, the first heat exchanger 30, the second heat exchanger 60, and the expansion device 40 may be included an outdoor unit that is located to be exposed to outdoor air. The water pipe 90 through which water circulating in the indoor space flows may be connected to the first heat exchanger 30. The water pipe 90 may include an inlet pipe 92 through which water flows into the first heat exchanger 30 and an outlet pipe 94 through which water is discharged from the first heat exchanger 30. Both the water inlet pipe 92 and the water outlet pipe 94 may be connected to the first heat exchanger 30. A pump 93 that introduces water into the first heat exchanger 30 may be disposed in the water inlet pipe 92. The water circulating in the water pipe 90 may exchange heat with the refrigerant circulating in a refrigerant pipe 80 of the first heat exchanger 30. Through the above configuration, the heat supply apparatus 1 may exchange heat between the water and the refrigerant to warm up or cool down the indoor space.

The heat supply apparatus 1 may include the refrigerant pipe 80 connecting the compressor 10, the first heat exchanger 30, and the second heat exchanger 60. The refrigerant pipe 80 may form a closed circuit. The refrigerant discharged from the compressor 10 may circulate through the refrigerant pipe 80, such as to circulate in clockwise or counter-clockwise directions.

The refrigerant pipe 80 may include a first pipe 81 connected to the first heat exchanger 30, a second pipe 82 connecting the first heat exchanger 30 and the expansion device 40, a third pipe 83 connecting the expansion device 40 and the second heat exchanger 60, and a fourth pipe 84 connected to the second heat exchanger 60. The first pipe 81 may be located between the compressor 10 and the first heat exchanger 30. The fourth pipe 84 may be located between the compressor 10 and the second heat exchanger 60.

The heat supply apparatus 1 may include a four-way valve 20 located between the compressor 10 and the first heat exchanger 30. The four-way valve 20 may be located between the compressor 10 and the second heat exchanger 60. The four-way valve 20 may switch the refrigerant pipe 80 depending on the operation mode. For example, the four-way valve 20 may fluidly connect the compressor 10 and the first heat exchanger 30 during the heating operation and may fluidly connect the compressor 10 and the second heat exchanger 60 during the cooling operation or during a defrost operation. For example, during the heating operation, the refrigerant discharged from the compressor 10 may flow first to the first heat exchanger 30 through the four-way valve 20, and during the cooling or defrost operation, the refrigerant discharged from the compressor 10 may flow first to the second heat exchanger 60 through the four-way valve 20.

The first pipe 81 may connect the first heat exchanger 30 and the four-way valve 20. The fourth pipe 84 may connect the second heat exchanger 60 and the four-way valve 20.

The refrigerant pipe 80 may include an inlet pipe 85 through which the refrigerant flows into the compressor 10. The inlet pipe 85 may be connected to an inlet side of the compressor 10. The inlet pipe 85 may connect the compressor 10 and the four-way valve 20.

The compressor 10 may be connected to the four-way valve 20. The refrigerant pipe 80 may include an outlet pipe 86 through which the refrigerant flows after being discharged from the compressor 10. The outlet pipe 86 may be connected to the outlet side of the compressor 10. The outlet pipe 86 may connect the compressor 10 and the four-way valve 20.

The heat supply apparatus 1 may include an accumulator (or gas-liquid separator) 70 located between the four-way valve 20 and the compressor 10. The accumulator 70 may be located in the inlet pipe 85. The accumulator 70 may be located upstream of the compressor 10 in the refrigerant flow path 80.

During the heating operation, the outlet pipe 86 may be connected to the first refrigerant pipe 81 through the four-way valve 20, and the inlet pipe 85 may be connected to the fourth refrigerant pipe 84 through the four-way valve 20. Through the above configuration, the refrigerant discharged from the compressor 10 may flow first to the first heat exchanger 30. During the cooling or defrost operation, the outlet pipe 86 may be connected to the fourth refrigerant pipe 84 through the four-way valve 20, and the inlet pipe 85 may be connected to the first refrigerant pipe 81 through the four-way valve 20. Through the above configuration, the refrigerant discharged from the compressor 10 may first flow to the second heat exchanger 60 during the cooling or defrost operation.

The first heat exchanger 30 may be a water-refrigerant heat exchanger that exchanges heat between water and refrigerant flowing through the first heat exchanger 30. For example, the first heat exchanger 30 may be a plate-type heat exchanger through which water and refrigerant flow separately. Water circulating from the indoor space may pass through the first heat exchanger 30. The refrigerant circulating from the outdoor unit may pass through the first heat exchanger 30. The refrigerant may circulate in the outdoor unit and exchange heat with outdoor air in the second heat exchanger 60 and exchange heat with water in the first heat exchanger 30. Through the above process, the water circulating in the indoor space may be heated or cooled. For example, during the heating operation, the heat supply apparatus 1 may heat water passing through the first heat exchanger 30 to warm up the indoor space or supply hot water. During the cooling operation, the first heat exchanger 30 may cool the flowing water to cool down the indoor space or supply cold water. Water and refrigerant passing through the first heat exchanger 30 may flow in opposite directions, such as water and refrigerant forming countercurrents.

During the heating operation, the refrigerant discharged from the compressor 10 may be directed first to the first heat exchanger 30. At this time, the first heat exchanger 30 may function as a condenser to exchange heat between the relatively warmer refrigerant and the water. The refrigerant that has passed through the first heat exchanger 30 may then sequentially flow through the expansion device 40 and the second heat exchanger 60.

During the cooling or defrost operation, the refrigerant discharged from the compressor 10 may be directed first to the second heat exchanger 60. The refrigerant discharged from the second heat exchanger 60 may then be directed to the first heat exchanger 30, such as being received at the first heat exchanger 30 after passing through the expansion device 40. At this time, the first heat exchanger 30 may function as an evaporator to exchange heat between the refrigerant and the water.

The second heat exchanger 60 may be an air-refrigerant heat exchanger 60 that exchanges heat between air and refrigerant. For example, the second heat exchanger 60 may be a fin-tube heat exchanger including tubes and fins through which refrigerant flows. Since the first heat exchanger 30 and the second heat exchanger 60 may be included an outdoor unit, the second heat exchanger 60 may exchange heat between outdoor air and refrigerant.

During the heating operation, the refrigerant discharged from the first heat exchanger 30 may then be directed to the second heat exchanger 60. At this time, the second heat exchanger 60 may function as an evaporator to exchange heat between the refrigerant and outdoor air. During the cooling or defrost operation, the refrigerant discharged from the compressor 10 may be directed first to the second heat exchanger 60. At this time, the second heat exchanger 60 may function as a condenser, and may then discharge the refrigerant to the first heat exchanger 30.

The expansion device 40 may be located between the first heat exchanger 30 and the second heat exchanger 60. During the heating operation, the refrigerant may pass through the expansion device 40 when flowing from the first heat exchanger 30 to the second heat exchanger 60 (e.g., counterclockwise in FIG. 1). During the cooling or defrost operation, the refrigerant may pass through the expansion device 40 when flowing from the second heat exchanger 60 to the first heat exchanger 30 (e.g., clockwise in FIG. 1). The expansion device 40 may be located between the second pipe 82 connected to the first heat exchanger 30 and the third pipe 83 connected to the second heat exchanger 60. Both the second pipe 82 and the third pipe 83 may be connected to the expansion device 40. For example, during the heating operation, the refrigerant may sequentially pass through the second pipe 82, the expansion device 40, and the third pipe 83. Conversely, during a cooling or defrost operation, the refrigerant may sequentially pass through the third pipe 83, the expansion device 40, and the second pipe 82.

The expansion device 40 may include a first expansion device 42 connected to the second pipe 82 and the third pipe 83. The first expansion device 42 may be an expansion valve. The expansion device 40 may also include a second expansion device 44 connected in parallel with the first expansion device 42. The second expansion device 44 may be an electronic expansion valve (EEV) controlled by an electrical signal. The degree of opening of the second expansion device 44 may be adjusted according to electrical signals. For example, the degree of opening of the second expansion device 44 may be adjusted between fully closed and fully open states. Through the above process of adjusting the degree of opening, the second expansion device 44 may adjust the total flow path area of the refrigerant pipe 80 connecting the first heat exchanger 30 and the second heat exchanger 60. For example, if the second expansion device 44 is fully closed, the refrigerant pipe 80 connecting the first heat exchanger 30 and the second heat exchanger 60 may form a minimum flow path area (e.g., only including a flow path area corresponding to the first expansion valve 42 connected to the second pipe 82 and the third pipe 83. On the other hand, if the second expansion device 44 is fully opened, the refrigerant pipe 80 connecting the first heat exchanger 30 and the second heat exchanger 60 may form a maximum flow path area (e.g., including a flow path area corresponding to both the first expansion valve 42 and the second expansion device 44. Through the above configuration, the second expansion device 44 may allow the refrigerant to be circulated smoothly by adjusting the open area of the flow path where the expansion device 40 is disposed.

The size of the second expansion device 44 may be larger than the size of the first expansion device 42. The open flow path area of the second expansion device 44 may be larger than the flow path area of the first expansion device 42. Through the relatively larger size of the second expansion device 44, the degree of opening of the second expansion device 44 may be controlled more precisely.

In another example, the expansion device 40 may be a single expansion device. A single expansion device 40 may be an electronic expansion valve (EEV) whose opening is controlled according to an electrical signal. At this time, the degree of opening of the single expansion device 40 may be adjusted between the minimum degree of opening forming the minimum flow path area and the full degree of opening forming the maximum flow path area. For example, the degree of opening of the single expansion device 40 may be adjusted such that expansion device 40 is maintained in at least a partially open state and not fully closed.

The heat supply device 1 may include a bypass pipe 46 in which the second expansion device 44 may be disposed. The bypass pipe 46 may be connected to the refrigerant pipe 80 connecting the first heat exchanger 30 and the second heat exchanger 60. For example, one end of the bypass pipe 46 may be connected to the second pipe 82, and another end of the bypass pipe 46 may be connected to the third pipe 83.

Figure 2:
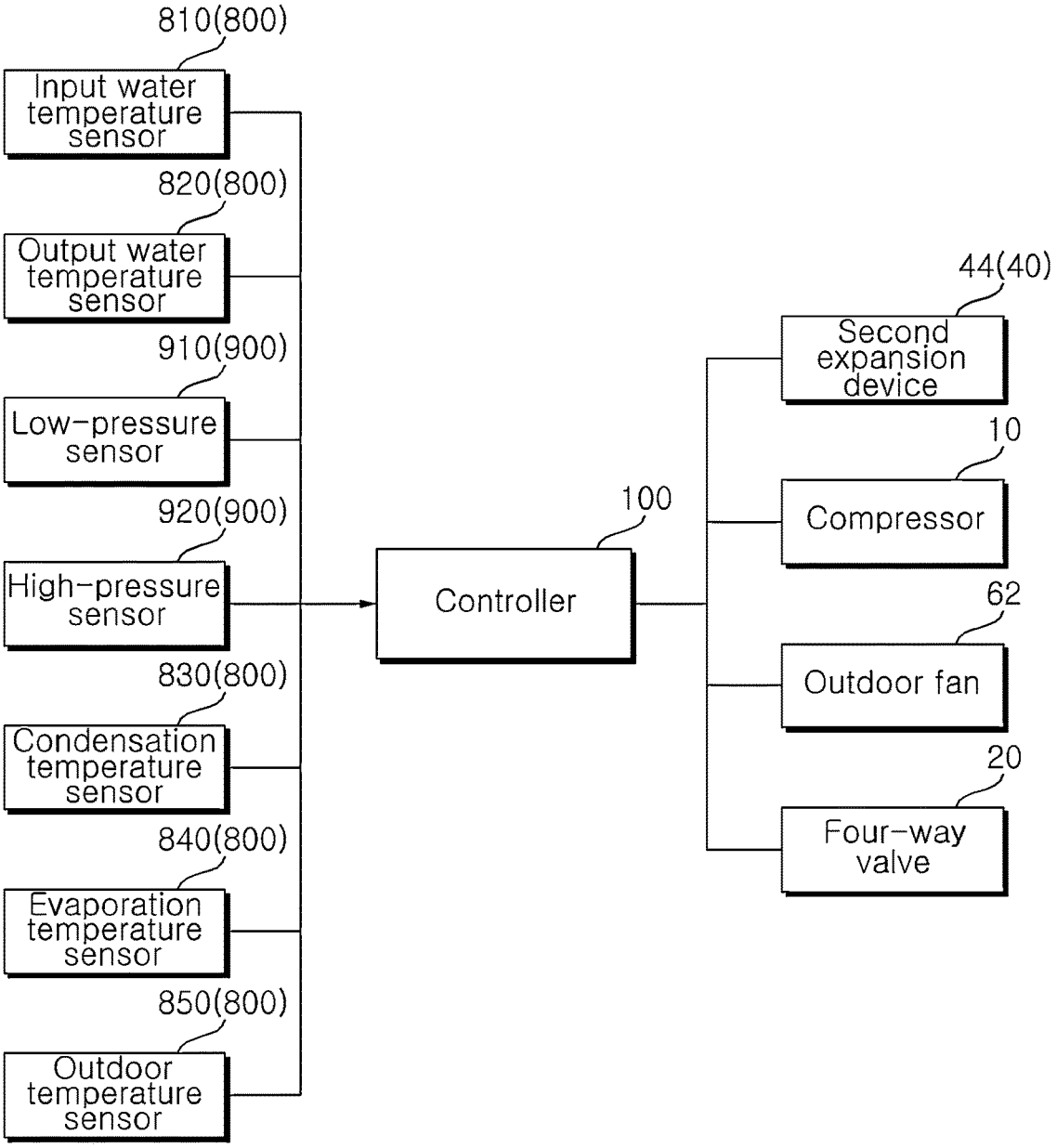
FIG. 2 illustrates a control block diagram of a heat supply apparatus according to one embodiment.

Referring to FIG. 2, the heat supply apparatus 1 may include a controller 100, a temperature sensor 800 collecting temperature information, and a pressure sensor 900 collecting pressure information. For example, the heat supply apparatus 1 may include the controller 100 that collects information and controls the operating state of the heat supply apparatus 1.

In certain examples, the controller 100 may control the second expansion device 44. For example, the controller 100 may open and close the second expansion device 44, and the controller 100 may adjust the degree of opening of the second expansion device 44.

In certain examples, the controller 100 may control, respectively operation of the compressor 10 and an outdoor fan 62 that generates an air flow through the second heat exchanger 60. For example, if an operation signal is input, the controller 100 may drive the compressor 10 and the outdoor fan 62, respectively.

In certain examples, the controller 100 may control the four-way valve 20. For example, when a heating operation signal is input, the controller 100 may control the four-way valve 20 so that the first pipe 81 and the outlet pipe 86 are connected to each other to guide compressed refrigerant from the compressor 10 to the first heat exchanger 30, and when a cooling or defrost operation signal is input, the controller 100 may control the four-way valve 20 so that the fourth pipe 84 and the inlet pipe 85 are connected to each other to guide refrigerant from the compressor 10 to the second heat exchanger 60.

In certain examples, the temperature sensor 800 may include a condensation temperature sensor 830 that measures the temperature of the refrigerant flowing into the first heat exchanger 30. Condensation temperature may refer to the temperature of refrigerant flowing into the first heat exchanger 30. The condensation temperature sensor 830 may be located, for example, in the first pipe 81 or the first heat exchanger 30, such as to measure a temperature of the refrigerant before a heat exchange with the water. The condensation temperature sensor 830 may transmit the measured condensation temperature to the controller 100.

In certain examples, the temperature sensor 800 may include an input water temperature sensor 810 that measures the temperature of water flowing into the first heat exchanger 30. The input water temperature may refer to the temperature of water flowing into the first heat exchanger 30. The input water temperature sensor 810 may be located in the input water pipe 92 or an inlet section of the first heat exchanger 30, such as to measure a temperature of the water before a heat exchange with the refrigerant. The input water temperature sensor 810 may transmit the measured input water temperature to the controller 100.

In certain examples, the temperature sensor 800 may include an output water temperature sensor 820 that measures the temperature of water flowing out from the first heat exchanger 30. The output water temperature may refer to the temperature of water flowing out from the first heat exchanger 30. The output water temperature sensor 820 may be located in the output water pipe 94 or an outlet section of the first heat exchanger 30, such as to measure a temperature of the water after a heat exchange with the refrigerant. The output water temperature sensor 820 may transmit the measured output water temperature to the controller 100.

In certain examples, the temperature sensor 800 may include an evaporation temperature sensor 840 that measures the temperature of the refrigerant flowing into the second heat exchanger 60. The evaporation temperature may refer to the temperature of the refrigerant flowing into the second heat exchanger 60. Alternatively, the evaporation temperature may refer to the evaporation temperature of the refrigerant at a low-pressure side (e.g., an inlet side) of the compressor 10. The evaporation temperature sensor 840 may be disposed on the low-pressure side of the refrigerant pipe 80. For example, the evaporation temperature sensor 840 may be disposed in any one of the third pipe 83, the fourth pipe 84, or the inlet pipe 85. The evaporation temperature sensor 840 may transmit the measured evaporation temperature to the controller 100.

In certain examples, the temperature sensor 800 may include an outdoor temperature sensor 850 that measures the temperature of outdoor air. The outdoor temperature sensor 850 may measure the temperature of airflow formed by the outdoor fan 62. The outdoor temperature sensor 850 may be located in the second heat exchanger 60 or at another location to measure outside air temperature. The outdoor temperature sensor 850 may transmit the measured outdoor temperature information to the controller 100.

In certain examples, the pressure sensor 900 may include a low-pressure sensor 910 that measures a pressure of refrigerant in the low-pressure (e.g., inlet) side of the compressor 10. The low-pressure sensor 910 may measure the pressure of the refrigerant flowing into the compressor 10. The low-pressure sensor 910 may be located on the low-pressure side of the refrigerant pipe 80. For example, the low-pressure sensor 910 may be located in any one of the inlet pipe 85, the third pipe 83, or the fourth pipe 84 of the compressor 10. The low-pressure sensor 910 may transmit the measured low-pressure information to the controller 100.

In certain examples, the pressure sensor 900 may include a high-pressure sensor 920 that measures a pressure of refrigerant in the high-pressure (e.g., outlet) side of the compressor 10. The high-pressure sensor 920 may measure the pressure of the refrigerant discharged from the compressor 10. The high-pressure sensor 920 may be located on the high-pressure side of the refrigerant pipe 80. For example, the high-pressure sensor 920 may be located in any one of the outlet pipe 86, the first pipe 81, or the second pipe 82 receiving compressed refrigerant from the compressor 10. The high-pressure sensor 920 may transmit the measured high-pressure information to the controller 100.

Figure 3:
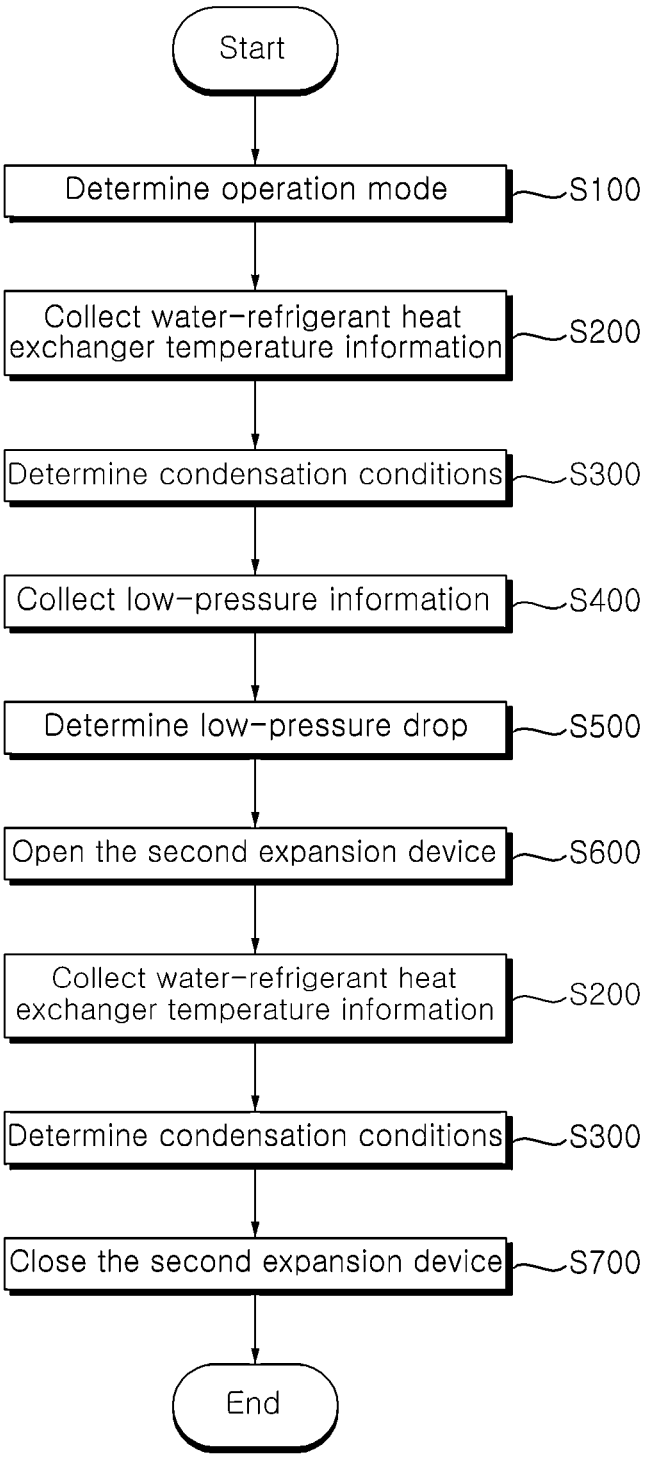
FIG. 3 is a flow chart of a method for controlling a heat supply apparatus according to one embodiment.

Referring to FIG. 3, a method for controlling the heat supply apparatus 1 in certain implementations may comprise determining an operation mode S100, collecting temperature information of the water-refrigerant heat exchanger 30 during a heating operation S200, determining whether condensation conditions for refrigerant are satisfied through collected temperature information S300, collecting low-pressure information of the compressor 10 S400, determining whether the low-pressure of the compressor 10 has dropped through the collected low-pressure information S500, opening the second expansion device 44 when the low-pressure of the compressor 10 decreases S600, again collecting temperature information of the water-refrigerant heat exchanger 30 after opening of the second expansion device 44 S200, again determining whether condensation conditions for refrigerant are satisfied according to the opening of the second expansion device 44 S300, and closing the second expansion device 44 when the condensation conditions for the refrigerant are satisfied S700.

In the determining of the operation mode S100, the controller 100 may determine whether the heat supply device 1 is in the heating operation, a cooling operation, or a defrost operation. The controller 100 may determine that an operation mode in which refrigerant discharged from the compressor 10 initially flows into the first heat exchanger 30 as the heating operation. Additionally or alternatively, the controller 100 may determine the operation mode in which the first pipe 81 and the outlet pipe 86 are fluidly connected to each other as the heating operation. The controller 100 may determine the operation mode in which the refrigerant discharged from the compressor 10 initially flows into the second heat exchanger 60 as the cooling (or defrost) operation. Additionally or alternatively, the controller 100 may determine the operation mode in which the fourth pipe 84 and the outlet pipe 86 are fluidly connected to each other as the cooling (or defrost) operation.

The S200 step of collecting temperature information of the water-refrigerant heat exchanger 30 may include collecting temperature information of at least one of water and/or refrigerant. At this time, the input water temperature sensor 810 may measure the temperature of water flowing into the water-refrigerant heat exchanger 30. The output water temperature sensor 820 may measure the temperature of water flowing out from the water-refrigerant heat exchanger 30. The condensation temperature sensor 830 may measure the temperature of refrigerant flowing into the water-refrigerant heat exchanger 30. The temperature information collected in the step of collecting temperature information of the water-refrigerant heat exchanger 30 may be transmitted to the controller 100.

In the step of determining condensation conditions S300, the controller 100 may determine whether condensation conditions for the refrigerant are satisfied. At this time, the controller 100 may determine whether condensation conditions for the refrigerant are satisfied by comparing the condensation temperature and the input water temperature. In addition to or instead of comparing the condensation temperature and the input water temperature, the controller 100 may also compare the input water temperature and the output water temperature to determine whether condensation conditions for the refrigerant are satisfied.

In the step of collecting low-pressure information S400, the controller 100 may collect low-pressure information of the compressor 10 through the low-pressure sensor 910. In the step of determining whether the low-pressure has dropped S500, the controller 100 may determine whether the collected low-pressure value of the compressor 10 is outside an appropriate pressure range of the compressor 10. For example, the controller 100 may determine that the low-pressure has dropped when the collected low-pressure value of the compressor 10 is lower than the appropriate low-pressure of the compressor.

When the controller 100 determines that the low-pressure has dropped in S500, the controller 100 may open or increase the opening amount of the second expansion device 44 in step S600. Through this step, the gaseous refrigerant that has not been condensed while passing through the first heat exchanger 30 during the heating process may smoothly pass through the opened second expansion device 44.

After opening the second expansion device 44 in step S600, the controller 100 may again collect temperature information of water and/or refrigerant in the water-refrigerant heat exchanger 30 through the temperature sensor 800 in step S200. For example, the controller 100 may collect temperature information of the refrigerant flowing into the water-refrigerant heat exchanger 30 through the condensation temperature sensor 830. Also, the controller 100 may collect temperature information of the refrigerant flowing into the water-refrigerant heat exchanger 30 through the input water temperature sensor 810. Also, the controller 100 may collect temperature information of water flowing out of the water-refrigerant heat exchanger 30 through the output water temperature sensor 820.

After opening the second expansion device 44 in step S600, the controller 100 may again determine whether condensation conditions for the refrigerant are satisfied in step S300. The controller 100 may determine whether condensation conditions for the refrigerant are satisfied by comparing the condensation temperature and the input water temperature. Also, instead of or in addition to comparing the condensation temperature and the input water temperature, the controller 100 may compare the input water temperature and the output water temperature to determine whether condensation conditions for the refrigerant are satisfied in step S300.

After opening the second expansion device 44 in step S600, the controller 100 may then close the second expansion device 44 when the condensation conditions for the refrigerant are satisfied in step S700. In other example, S700 may include reducing an opening amount of the second expansion device 44 when the condensation conditions for the refrigerant are satisfied in step S700

Figure 4:
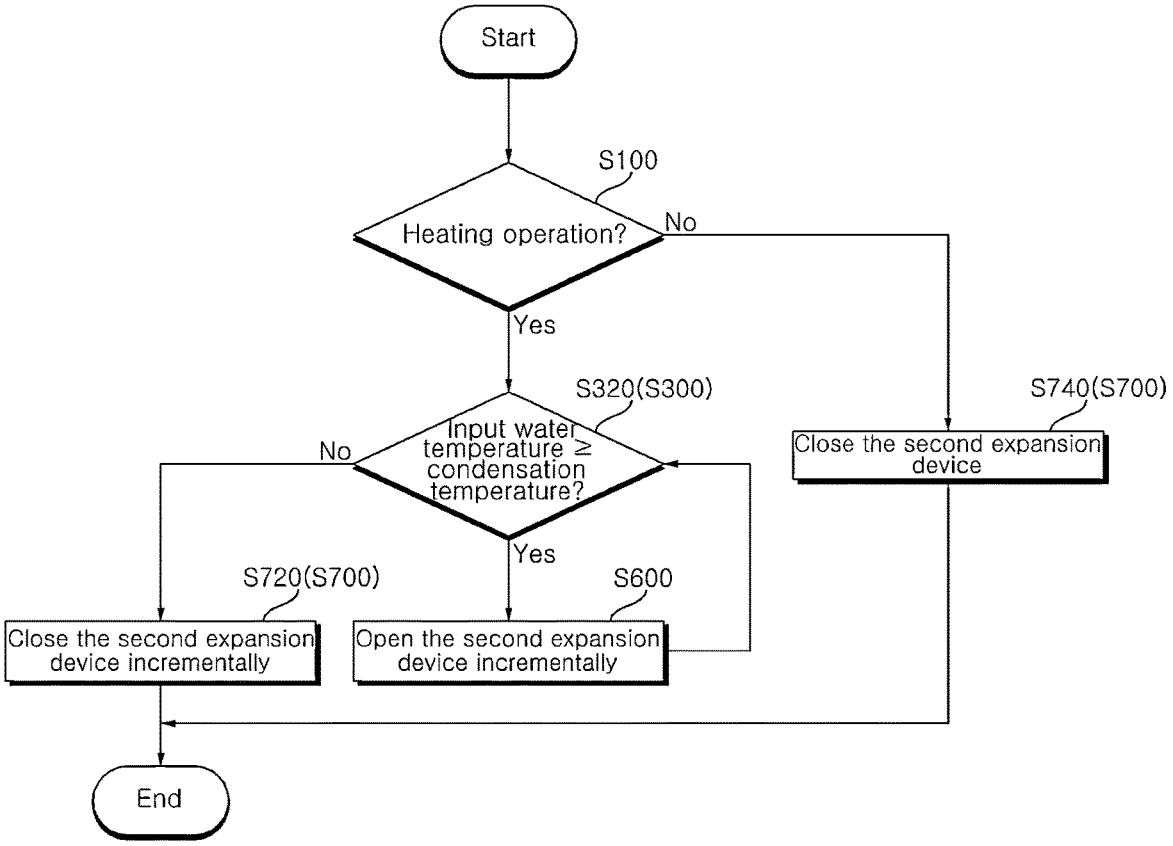
FIG. 4 is a flow chart of a method for controlling a heat supply apparatus according to one embodiment.

Referring to FIG. 4, the a for controlling the heat supply apparatus 1 may comprise determining whether the current operation mode is the heating operation S100, closing the second expansion device 44 (S740) when the current operation mode is not the heating operation (S100—No), comparing input water temperature and condensation temperature of the water-refrigerant heat exchanger 30 S320 when the operation mode is heating operation (S100—Yes), opening the second expansion device 44 S600 when the input water temperature is higher than the condensation temperature (S320—Yes), comparing again the input water temperature and the condensation temperature S320, and closing the second expansion device 44 (S720) when the input water temperature is lower than the condensation temperature (S320—No).

In the step of determining the operation mode S100, the controller 100 may determine whether the heat supply apparatus 1 is in the heating operation. The controller 100 may determine the operation mode as the cooling (or defrost) operation when the refrigerant discharged from the compressor 10 flows into the second heat exchanger 60. Also, the controller 100 may determine the operation mode as the cooling (or defrost) operation when the fourth pipe 84 and the inlet pipe 85 are connected to each other. When the controller 100 determines that the heat supply apparatus 1 is in the cooling (or defrost) operation (S100—No), the controller 100 may close the second expansion device 44 (S740). For example, the controller 100 may completely close the second expansion device 44 during the cooling (or defrost) operation. At this time, the refrigerant may pass through only the first expansion device 42.

The controller 100 may determine the operation mode as the heating operation (S100—Yes) when the refrigerant discharged from the compressor 10 flows into the first heat exchanger 30. Also, the controller 100 may determine the operation mode as the heating operation when the first pipe 81 and the outlet pipe 86 are connected to each other.

When the controller 100 determines that the heat supply device 1 is in the heating operation (S100—Yes), the controller 100 may compare the input water temperature and the condensation temperature to determine whether the condensation conditions for the refrigerant are satisfied S320. For example, when the input water temperature is higher than the condensation temperature, the controller 100 may determine that the condensation conditions for the refrigerant are not satisfied. Conversely, the controller 100 may determine that the condensation conditions for the refrigerant are satisfied when the input water temperature is lower than the condensation temperature.

When the controller 100 determines that the condensation conditions are not satisfied (S320—Yes), the controller 100 may open the second expansion device 44 (S600). At this time, the controller 100 in S600 may open the second expansion device 44 incrementally. For example, the controller 100 in S600 may control the second expansion device 44 to be opened incrementally by a predetermined pulse P1 at predetermined intervals T1. Through the above process, the second expansion device 44 may be opened through a predetermined period of time in S600.

After opening the second expansion device 44 in S600, the controller 100 may determine again whether the condensation conditions are satisfied in S320. When it is determined that the condensation conditions are not satisfied (S320—Yes), the controller 100 may maintain the open state of the second expansion device 44 or may further open the second expansion device 44 in S600. When it is determined that the condensation conditions are satisfied (S320—No), the controller 100 may close the second expansion device 44 (S720).

After opening the second expansion device 44, the controller 100 may close the second expansion device 44 if it is determined that the condensation conditions are satisfied (S320—No). At this time, the controller 100 may close the second expansion device 44 incrementally in S720. For example, the controller 100 may control the second expansion device 44 to be closed by a predetermined pulse P2 at predetermined intervals T2. Through the above process, the second expansion device 44 may be closed through a predetermined period of time in S720.

The speed at which the controller 100 incrementally closes the second expansion device 44 in S720 may be greater than the speed at which the second expansion device 44 is incrementally opened in S600. For example, the time taken to close the second expansion device 44 from the open state in S720 may be shorter than the time taken to open the second expansion device 44 from the closed state in S600. For example, when closing the second expansion device 44 in S720, the controller 100 may close the second expansion device 44 incrementally by the second pulse P2 at second intervals T2, and when opening the second expansion device 44, the controller 100 may open the second expansion device 44 incrementally by the first pulse P1 at first intervals T1 in S600, and at this time, the closing speed (V2=P2/T2) of the second expansion device in S720 may be larger than the opening speed (V1=P1/T1) of the second expansion device in S600.

Figure 5:
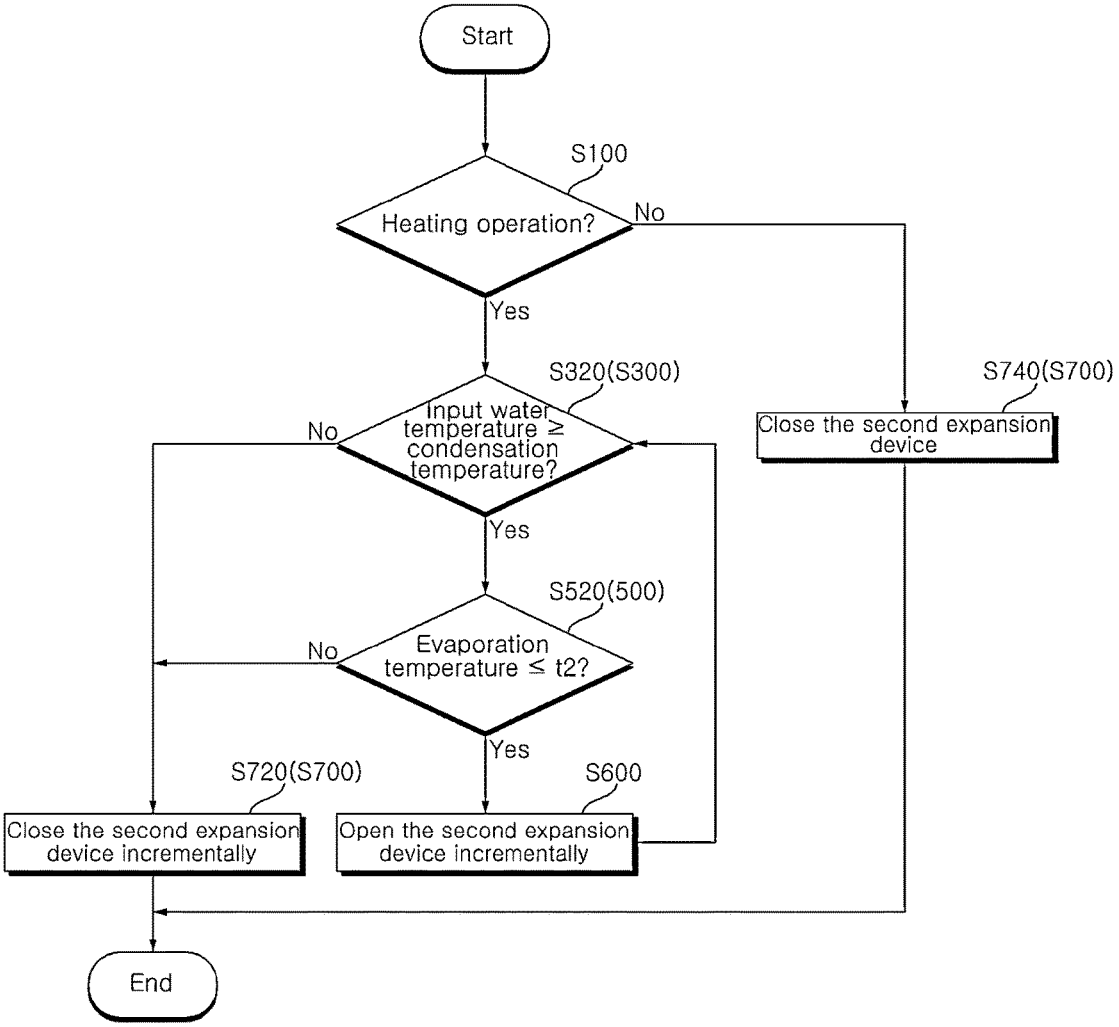
FIG. 5 is a flow chart of a method for controlling a heat supply apparatus according to another embodiment.

Referring to FIG. 5, a method for controlling the heat supply apparatus may include the step S500, S520 of determining whether the low-pressure of the compressor has dropped after the step S320 of determining whether the condensation conditions for the refrigerant are satisfied. For example, when the condensation conditions for the refrigerant are not satisfied, the controller 100 may determine whether low-pressure of the compressor 10 has dropped. The controller 100 may determine that low-pressure of the compressor 10 has dropped in S520 when the evaporation temperature of the refrigerant is less than or equal to a predetermined temperature value. The evaporation temperature of the refrigerant may be determined, for example, according to the pressure of the refrigerant. The evaporation temperature of the refrigerant may be the evaporation temperature of the refrigerant at the low-pressure side (e.g., inlet side) of the compressor 10. The compressor 10 may have an appropriate pressure range for normal operation and an appropriate refrigerant temperature range corresponding thereto.

When the evaporation temperature of the refrigerant due to the low-pressure of the compressor 10 does not fall within the appropriate refrigerant temperature range of the compressor 10, the controller 100 may determine that low-pressure of the compressor 10 has dropped.

When the evaporation temperature of the refrigerant due to the low-pressure of the compressor 10 falls within the appropriate refrigerant temperature range of the compressor 10, the controller 100 may determine that low-pressure of the compressor 10 has not dropped. At this time, the controller 100 may close the second expansion device 44. For example, when it is determined that low-pressure of the compressor 10 has not dropped (S520—Yes), the controller 100 may close the second expansion device 44 incrementally (S600).

When it is determined that low-pressure of the compressor 10 has dropped, the controller 100 may open the second expansion device 44 (S600). At this time, the controller 100 may open the second expansion device 44 incrementally. For example, the controller 100 may control the second expansion device 44 to be opened incrementally by a predetermined pulse P1 at predetermined intervals T1. Through the above process, the second expansion device 44 may be opened through a predetermined period of time in S600.

After opening the second expansion device 44 in S600, the controller 100 may determine again whether the condensation conditions are satisfied in S320. At this time, the controller 100 may collect input water temperature information and condensation temperature information again.

When it is determined that the condensation conditions are not satisfied (S320—Yes), the controller 100 may again determine whether low-pressure of the compressor 10 has dropped (S520). When the low-pressure drop of the compressor 10 is maintained (S520—Yes), the controller 100 may maintain the open state of the second expansion device 44 or may further open the second expansion device in S600. When it is determined that the low pressure drop of the compressor 10 has been resolved (S520—No), the controller 100 may close the second expansion device 44 (S720).

After opening the second expansion device 44, the controller 100 may close the second expansion device 44 in S720 when it is determined that the condensation conditions are satisfied (S320—No) or the low-pressure drop of the compressor 10 has been resolved (S520—No). At this time, the controller 100 may close the second expansion device 44 incrementally. For example, the controller 100 may control the second expansion device 44 to be closed incrementally by a predetermined pulse P2 at predetermined intervals T2. Through the above process, the second expansion device 44 may be closed through a predetermined period of time.

Figure 6:
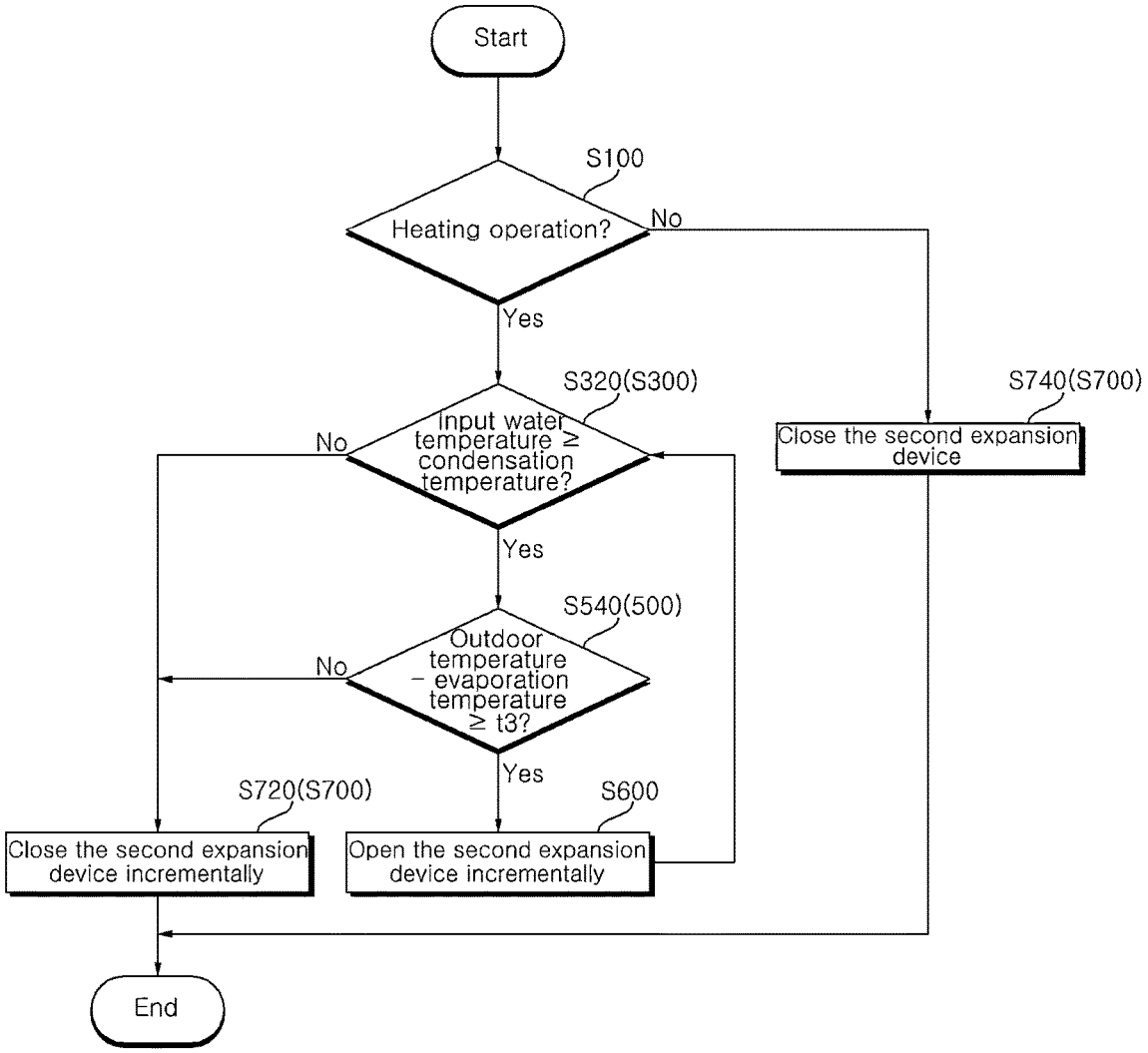
FIG. 6 is a flow chart of a method for controlling a heat supply apparatus according to yet another embodiment.

Referring to FIG. 6, a method for controlling the heat supply apparatus may include a step S540 of determining whether low-pressure of the compressor 10 has dropped by comparing the outdoor temperature and the evaporation temperature after the determining of whether the condensation conditions for the refrigerant are satisfied (S320).

When the condensation conditions for the refrigerant are not satisfied, the controller 100 may determine whether low-pressure of the compressor 10 has dropped by comparing the outdoor temperature and the evaporation temperature. The controller 100 may determine that low-pressure of the compressor 10 has dropped when the difference value between the outdoor temperature and the evaporation temperature is larger than or equal to a predetermined temperature value in S540. For example, when a value obtained by subtracting the evaporation temperature from the outdoor temperature is larger than or equal to a predetermined temperature value T3, the controller 100 may determine that the low-pressure of the compressor 10 has been dropped.

When it is determined that low-pressure of the compressor 10 has dropped (S540—Yes), the controller 100 may open the second expansion device 44 in S600. At this time, the controller 100 may open the second expansion device 44 incrementally. For example, the controller 100 may control the second expansion device 44 to be opened incrementally by a predetermined pulse P1 at predetermined intervals T1. Through the above process, the second expansion device 44 may be opened through a predetermined period of time.

After opening the second expansion device 44, the controller 100 may determine again whether the condensation conditions are satisfied in S320. At this time, the controller 100 may collect input water temperature information and condensation temperature information again.

When it is determined that the condensation conditions are not satisfied (S320—Yes), the controller 100 may again determine whether low-pressure of the compressor 10 has dropped in S540. When the low-pressure drop of the compressor 10 is maintained (S540—Yes), the controller 100 may maintain the open state of the second expansion device 44 or may further open the second expansion device 400 (S600). When it is determined that the low pressure drop of the compressor 10 has been resolved (S540—No), the controller 100 may close the second expansion device 44 in S720.

After opening the second expansion device 44, the controller 100 may close the second expansion device 44 in S720 when it is determined that the condensation conditions are satisfied (S320—No) or the low-pressure drop of the compressor 10 has been resolved (S540—No). At this time, the controller 100 may close the second expansion device 44 incrementally. For example, the controller 100 may control the second expansion device 44 to be closed incrementally by a predetermined pulse P2 at predetermined intervals T2. Through the above process, the second expansion device 44 may be closed through a predetermined period of time.

Figure 7:
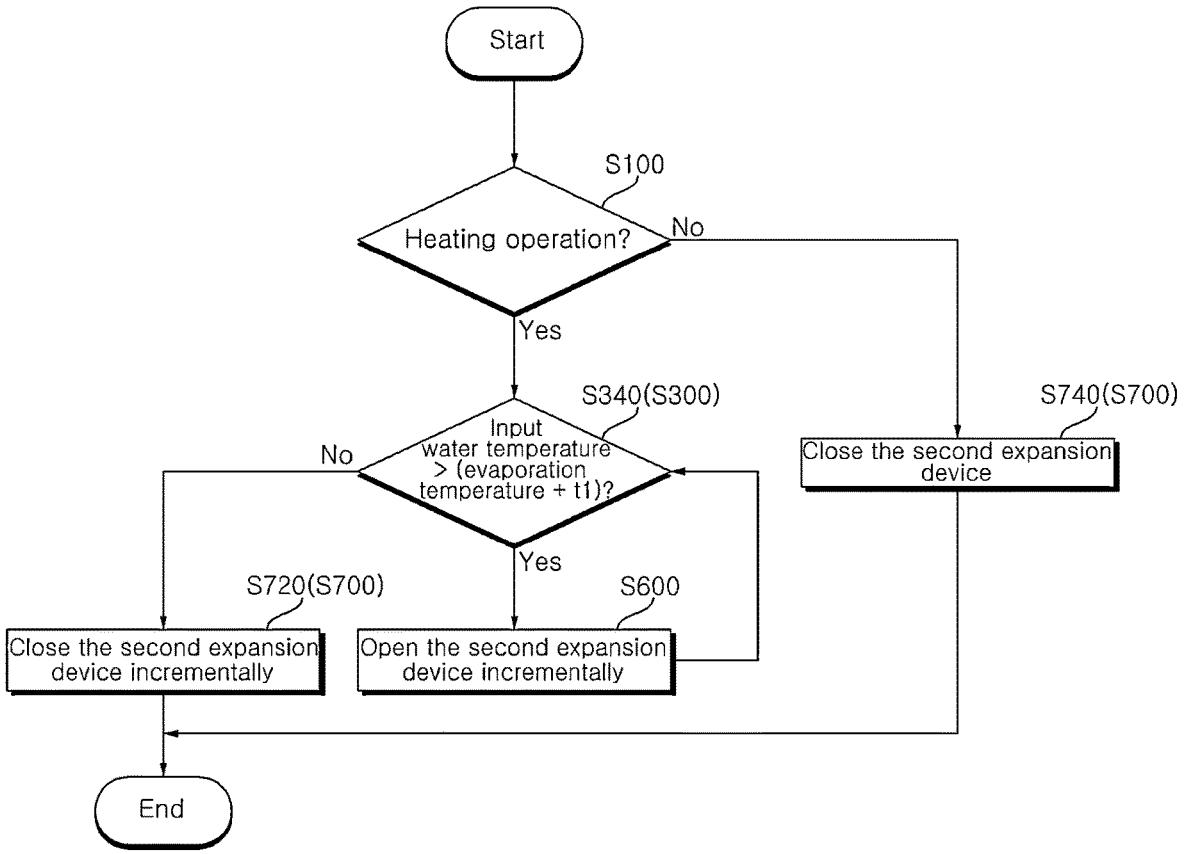
FIG. 7 is a flow chart of a method for controlling a heat supply apparatus according to still another embodiment.
Figure 8:
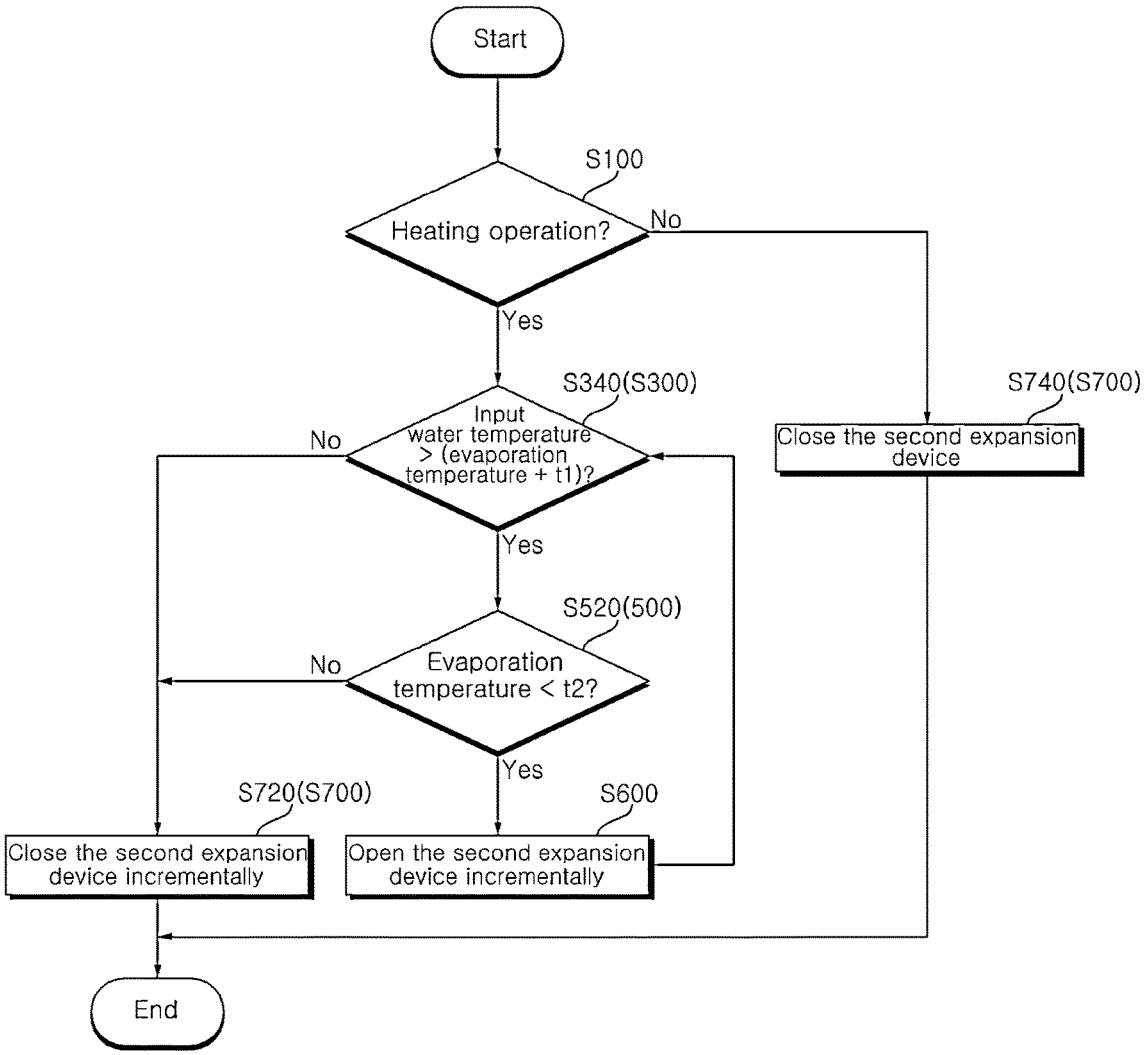
FIG. 8 is a flow chart of a method for controlling a heat supply apparatus according to further another embodiment.
Figure 9:
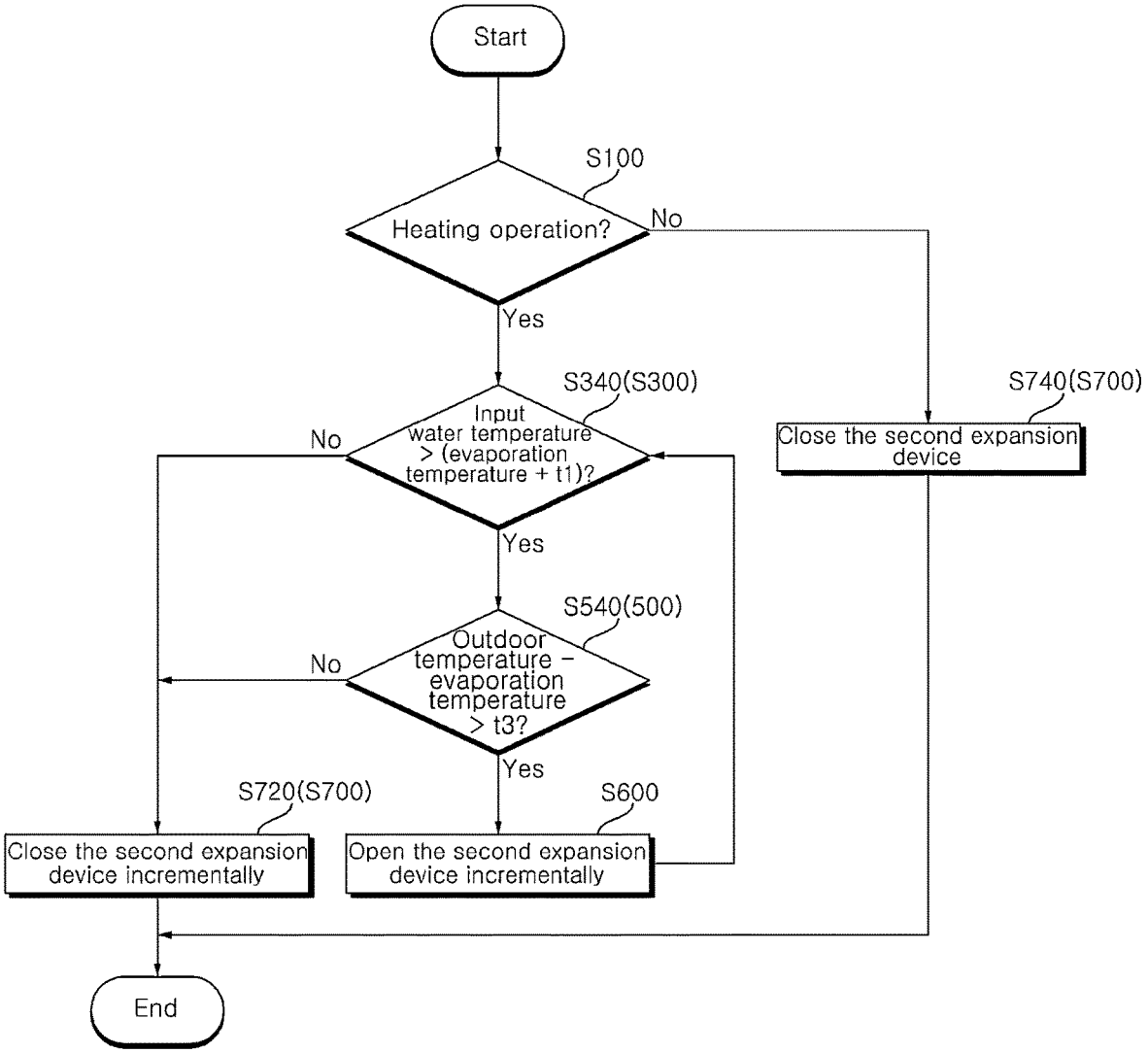
FIG. 9 is a flow chart of a method for controlling a heat supply apparatus according to yet still another embodiment.

Referring to FIGS. 7 to 9, during a heating operation, comparing the input water temperature and the evaporation temperature of the water-refrigerant heat exchanger 30 in S340 may be included in another implementation of the operating method. For those steps excluding the step S300 of determining whether the condensation conditions for the refrigerant are satisfied, descriptions of FIGS. 4 to 6 may be applied to FIGS. 7 to 9, respectively.

In the step S300 of determining whether condensation conditions for refrigerant are satisfied, the controller 100 may determine that the condensation conditions for refrigerant are not satisfied when the input water temperature is higher than or equal to the evaporation temperature by a predetermined temperature value. For example, the controller 100 may determine that the condensation conditions for refrigerant are not satisfied when the input water temperature is higher than or equal to the evaporation temperature by a predetermined temperature value t1 in S340.

If the input water temperature is smaller than the value obtained by adding a predetermined temperature value to the evaporation temperature, the controller 100 may determine that the condensation conditions for the refrigerant are satisfied. At this time, the controller 100 may close the second expansion device 44 (S720). For example, when the input water temperature is smaller than the value obtained by adding a predetermined temperature value t1 to the evaporation temperature (S340—No), the controller 100 may determine that the condensation conditions for the refrigerant are satisfied and control the second expansion device to be closed incrementally by a predetermined pulse P2 at predetermined intervals T2.

Figure 10:
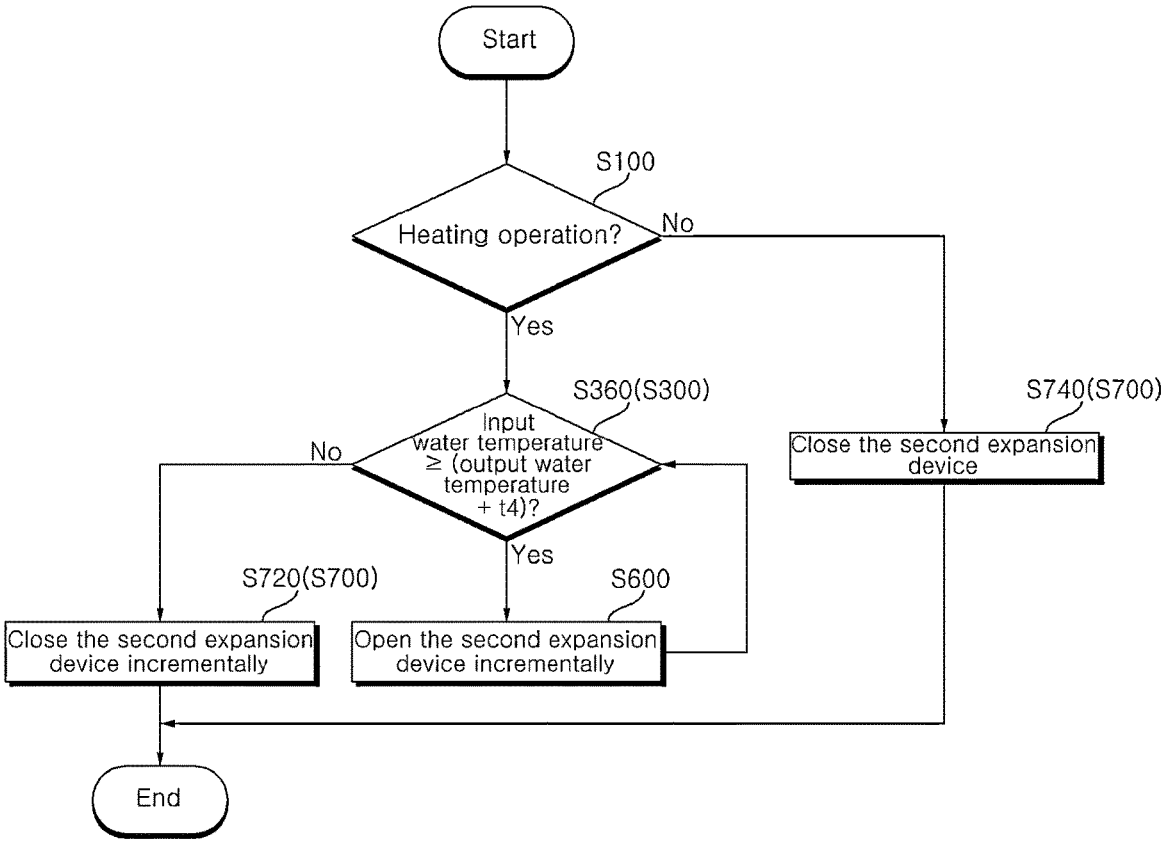
FIG. 10 is a flow chart of a method for controlling a heat supply apparatus according to yet further another embodiment.

Referring to FIG. 10, in the step of determining whether the condensation conditions are satisfied in S300, the controller may determine whether the condensation conditions for the refrigerant are satisfied by comparing the input water temperature and the output water temperature in S360. When the input water temperature is higher than or equal to the output water temperature by a predetermined temperature, the controller may determine that the condensation conditions for the refrigerant are not satisfied. For example, the controller 100 may determine that the condensation conditions for the refrigerant are not satisfied when the input water temperature is higher than or equal to the output water temperature by a predetermined temperature t4 in S360.

If the input water temperature is smaller than the value obtained by adding a predetermined temperature value to the evaporation temperature, the controller 100 may determine that the condensation conditions for the refrigerant are satisfied. At this time, the controller 100 may close the second expansion device 44. For example, when the input water temperature is higher than or equal to the output water temperature by a predetermined temperature t4, the controller 100 may determine that the condensation conditions for the refrigerant are satisfied (S360—Yes) and control the second expansion device to be closed incrementally by a predetermined pulse P2 at predetermined intervals T2 (S600).

For those steps excluding the step S300 of determining whether the condensation conditions for the refrigerant are satisfied, descriptions of FIGS. 4 to 6 may be applied.

Figure 11:
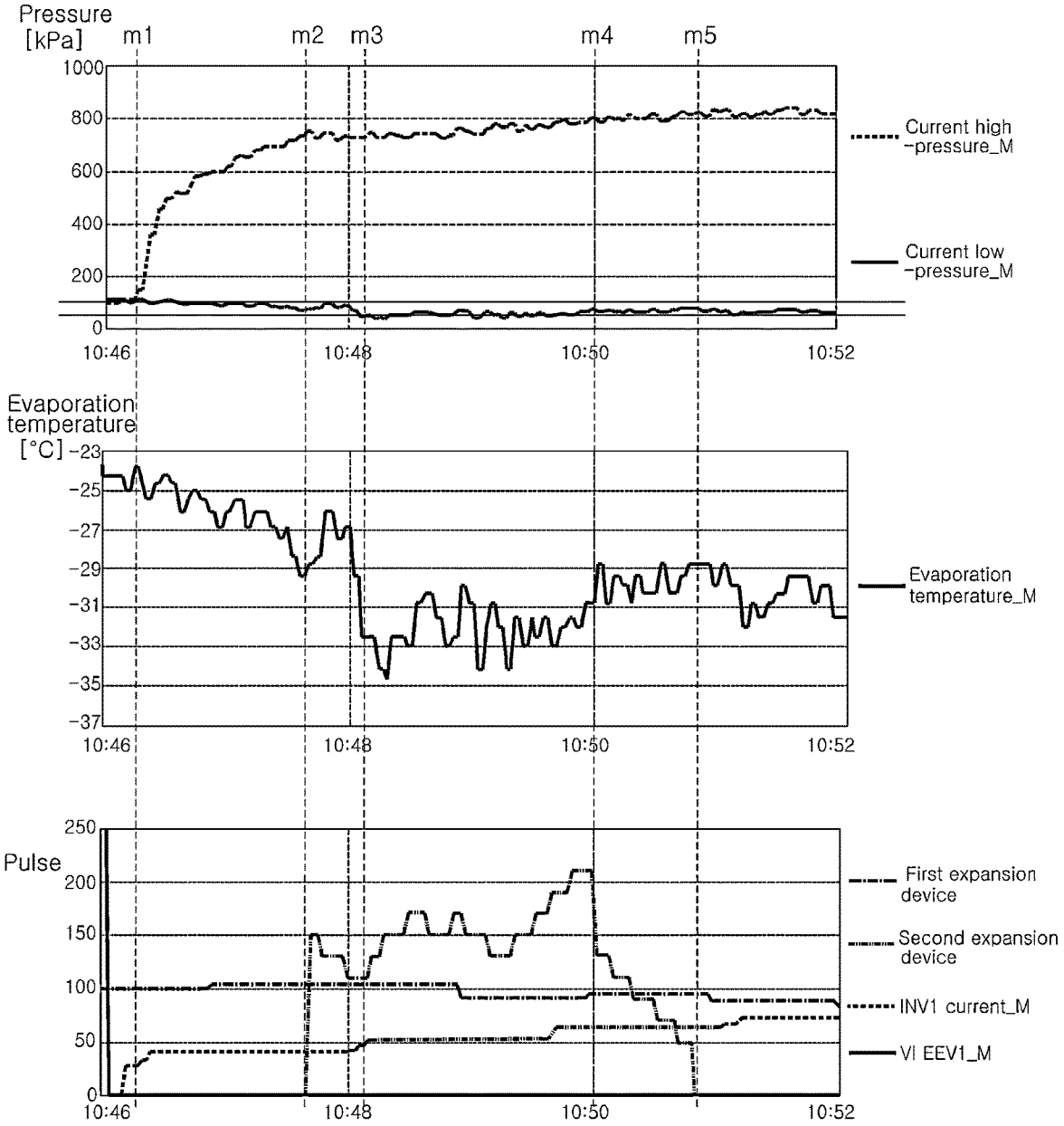
FIG. 11 is a graph of experimental results showing the pulses of the second expansion device due to the pressure and evaporation temperature of the heat supply device according to one embodiment.

Referring to FIG. 11, a pulse change of the second expansion device 44 according to the change in the low-pressure of the compressor 10 will be described. The upper graph of FIG. 11 shows the high-pressure and low-pressure of the compressor 10 over time. When the compressor 10 starts to operate, the high-pressure of the compressor 10 may increase from about 100 kPa to about 800 kPa, and the low-pressure of the compressor 10 may decrease from about 100 kPa to about 50 kPa.

The middle graph of FIG. 11 shows the evaporation temperature of the refrigerant over time. The evaporation temperature of the refrigerant may be calculated through the low-pressure of the compressor 10. For example, the change in low-pressure of the compressor 10 may be inferred through the evaporation temperature. For example, when the low-pressure of the compressor 10 increases, the evaporation temperature of the refrigerant may increase; when the low-pressure of the compressor 10 decreases, the evaporation temperature of the refrigerant may decrease. When the compressor 10 starts operating at the first time m1, the evaporation temperature of the refrigerant may be lowered from about −24 degrees to about −29 degrees by the second time m2. Thereafter, the evaporation temperature may change as the controller 100 adjusts the degree of opening of the second expansion device 44.

The lower graph of FIG. 11 shows the pulses of the second expansion device 44 over time. The pulse may correspond to the degree of opening of the second expansion device 44. As the pulse increases, the degree of opening of the second expansion device 44 may increase; as the pulse decreases, the degree of opening of the second expansion device 44 may decrease.

After the compressor 10 starts operating, the low-pressure and evaporation temperature of the compressor 10 decrease, and the controller 100 may open the second expansion device 44 in response to the decrease. For example, the compressor 10 starts to operate at a first time m1; as time passes, the high-pressure of the compressor 10 increases, and the low-pressure of the compressor 10 and the evaporation temperature of the refrigerant decrease. The controller 100 may detect a drop in low-pressure of the compressor 10 and, accordingly, open the second expansion device 44 at a second time m2. When the controller 100 opens the second expansion device 44 at the second time m2, the pulse of the second expansion device 44 may increase from 0 to about 150.

As the second expansion device 44 is opened, the evaporation temperature of the refrigerant may increase from about −29 degrees to about −26 degrees. The controller 100 may gradually adjust the degree of opening after opening the second expansion device 44. For example, the controller 100 may reduce the degree of opening immediately after opening the second expansion device 44. Accordingly, the pulse of the second expansion device 44 may be reduced from about 150 to about 110. As the degree of opening of the second expansion device 44 decreases, the evaporation temperature of the refrigerant may be lowered from about −26 degrees to about −33 degrees, and a low-pressure drop in the compressor 10 may occur.

The controller 100 may detect a decrease in the evaporation temperature of the refrigerant and increase the degree of opening of the second expansion device 44 at a third time m3. The controller 100 may detect a change in the evaporation temperature of the refrigerant while gradually increasing or decreasing the degree of opening of the second expansion device 44 in the period between the third time m4 and the fourth time m4. The controller 100 increases the pulse of the second expansion device 44 from about 110 to about 210 from the third time m3 to the fourth time m4, and accordingly, the evaporation temperature of the refrigerant decreases from about −35 degrees to about −29 degrees. In this example, the low-pressure of the compressor 10 gradually increases, and the low-pressure drop phenomenon may be resolved.

The evaporation temperature of the refrigerant may be maintained within an appropriate range after the fourth time m4. The controller 100 may determine that the evaporation temperature of the refrigerant is within an appropriate range after the fourth time m4 and close the second expansion device 44 incrementally. The second expansion device 44 may be completely closed at a fifth time m5.

Referring to FIGS. 1 to 11, a heat supply apparatus according to one aspect may comprise a compressor compressing refrigerant; a first heat exchanger being connected to the compressor through a refrigerant pipe and exchanging heat between refrigerant and water; a second heat exchanger being connected to the compressor through a refrigerant pipe and exchanging heat between refrigerant and air; a first expansion device disposed in a refrigerant pipe connecting the first heat exchanger and the second heat exchanger; a second expansion device connected to the first expansion device in parallel and opened and closed according to an electrical signal; and a controller controlling the degree of opening of the second expansion device, wherein, if heating operation is started, and temperature of water flowing into the first heat exchanger is higher than temperature of refrigerant flowing into the first heat exchanger, the controller opens the second expansion device.

According to another aspect, if temperature of water flowing into the first heat exchanger is higher than the temperature of refrigerant flowing into the first heat exchanger by a predetermined temperature value, the controller may open the second expansion device. According to another aspect, when opening the second expansion device, the controller may open the second expansion device incrementally by a predetermined pulse at predetermined intervals.

According to another aspect, if the temperature of water flowing into the first heat exchanger is higher than the temperature of refrigerant flowing into the first heat exchanger and evaporation temperature of the refrigerant flowing into the compressor is below a predetermined temperature, the controller may open the second expansion device. According to another aspect, if the temperature of water flowing into the first heat exchanger is higher than the temperature of refrigerant flowing into the first heat exchanger and the difference between evaporation temperature of the refrigerant flowing into the compressor and the temperature of outdoor air is more than a predetermined temperature, the controller may open the second expansion device.

According to another aspect, if the temperature of water flowing into the first heat exchanger is lower than the temperature of refrigerant flowing into the first heat exchanger after the second expansion device is opened, the controller may close the second expansion device. According to another aspect, when closing the second expansion device, the controller may close the second expansion device incrementally by a predetermined pulse at predetermined intervals.

According to another aspect, when opening the second expansion device, the controller may open the second expansion device incrementally by a predetermined pulse at predetermined intervals, and the closing speed of the second expansion device may be larger than the opening speed of the second expansion device. According to another aspect, when a cooling operation is started, the controller may close the second expansion device. According to another aspect, the open flow path area of the second expansion device may be larger than the flow path area of the first expansion device.

Referring to FIGS. 1 to 11, in a heat supply apparatus comprising a compressor, a water-refrigerant heat exchanger, an air-refrigerant heat exchanger, a first expansion device disposed between the water-refrigerant heat exchanger and the air-refrigerant heat exchanger, and a second expansion device connected to the first expansion device in parallel, a method for controlling the heat supply apparatus according to one aspect may comprise detecting temperatures of refrigerant and water flowing into the water-refrigerant heat exchanger when the refrigerant discharged from the compressor flows into the water-refrigerant heat exchanger; and if temperature of water flowing into the water-refrigerant heat exchanger is higher than temperature of refrigerant flowing into the water-refrigerant heat exchanger, opening the second expansion device. The opening of the second expansion device may include opening the second expansion device incrementally by a predetermined pulse at predetermined intervals.

According to another aspect, the method may further comprise measuring low-pressure of the compressor and determining whether the low-pressure of the compressor is less than or equal to predetermined pressure between the detecting of the temperature of the water-refrigerant heat exchanger and the opening of the second expansion device, wherein the opening of the second expansion device is performed when low-pressure of the compressor is less than or equal to predetermined pressure.

According to another aspect, the determining of whether low-pressure of the compressor is less than or equal to predetermined pressure may determine that low-pressure of the compressor is less than or equal to predetermined pressure when evaporation temperature of refrigerant according to measured low-pressure is less than or equal to a predetermined temperature.

According to another aspect, the determining of whether low-pressure of the compressor is less than or equal to predetermined pressure may determine that low-pressure of the compressor is less than or equal to predetermined pressure when the difference between evaporation temperature of refrigerant according to measured low-pressure and temperature of outdoor air is larger than or equal to a predetermined temperature value.

According to another aspect, if the temperature of water flowing into the water-refrigerant heat exchanger is lower than the temperature of the refrigerant flowing into the water-refrigerant heat exchanger when the refrigerant discharged from the compressor flows into the air-refrigerant heat exchanger, or the refrigerant discharged from the compressor flows into the water-refrigerant heat exchanger, the method may include closing the second expansion device.

According to another aspect, after the opening of the second expansion device, the method includes detecting temperatures of refrigerant and water flowing into the water-refrigerant heat exchanger; and closing the second expansion device if the temperature of water flowing into the water-refrigerant heat exchanger is lower than the temperature of refrigerant flowing into the water-refrigerant heat exchanger. According to another aspect, the closing of the second expansion device may include closing the second expansion device incrementally by a predetermined pulse at predetermined intervals.

Embodiments disclosed herein provide a heat supply apparatus with improved durability. Embodiments disclosed herein also provide a heat supply apparatus in which the low-pressure drop phenomenon of the compressor is improved. Embodiments disclosed herein further provide a heat supply apparatus in which the flow path area of the expansion device is adjusted. The technical effects are not limited to the technical effects described above, and other technical effects not mentioned herein may be understood to those skilled in the art to which the present disclosure belongs from the description below.

According to one aspect to achieve the object above, a heat supply apparatus may comprise a compressor compressing refrigerant; a first heat exchanger being connected to the compressor through a refrigerant pipe and exchanging heat between refrigerant and water; and a second heat exchanger being connected to the compressor through a refrigerant pipe and exchanging heat between refrigerant and air; a first expansion device disposed in a refrigerant pipe connecting the first heat exchanger and the second heat exchanger; a second expansion device connected to the first expansion device in parallel and opened and closed according to an electrical signal; and a controller controlling the degree of opening of the second expansion device, wherein the controller sends the refrigerant discharged from the compressor to the first heat exchanger during heating operation, wherein the controller opens the second expansion device when the heating operation is started and temperature of water flowing into the first heat exchanger is higher than temperature of refrigerant flowing into the first heat exchanger.

The controller opens the second expansion device when temperature of water flowing into the first heat exchanger is higher than the temperature of refrigerant flowing into the first heat exchanger by a predetermined temperature value.

The controller opens the second expansion device by a predetermined pulse at predetermined intervals when opening the second expansion device. The controller opens the second expansion device when the temperature of water flowing into the first heat exchanger is higher than the temperature of refrigerant flowing into the first heat exchanger and evaporation temperature of the refrigerant flowing into the compressor is below a predetermined temperature.

The controller opens the second expansion device when the temperature of water flowing into the first heat exchanger is higher than the temperature of refrigerant flowing into the first heat exchanger and the difference between evaporation temperature of the refrigerant flowing into the compressor and the temperature of outdoor air is more than a predetermined temperature.

The controller closes the second expansion device when the temperature of water flowing into the first heat exchanger is lower than the temperature of refrigerant flowing into the first heat exchanger after the second expansion device is opened. The controller closes the second expansion device by a predetermined pulse at predetermined intervals when closing the second expansion device.

The controller opens the second expansion device incrementally by a predetermined pulse at predetermined intervals when opening the second expansion device, and the closing speed of the second expansion device is larger than the opening speed of the second expansion device. The controller sends the refrigerant discharged from the compressor to the second heat exchanger during a cooling operation, the controller closes the second expansion device when the cooling operation is started.

The open flow path area of the second expansion device may be larger than the flow open path area of the first expansion device, allowing for easy adjustment of the degree of opening of the second expansion device. The controller opens the second expansion device when a heating operation is started, and temperature of water flowing into the first heat exchanger is higher than or equal to temperature of water flowing out from the first heat exchanger by a predetermined temperature value.

According to one aspect for achieving the object above, in a heat supply apparatus comprising a compressor, a water-refrigerant heat exchanger, an air-refrigerant heat exchanger, a first expansion device disposed between the water-refrigerant heat exchanger and the air-refrigerant heat exchanger, and a second expansion device connected to the first expansion device in parallel, a method for controlling the heat supply apparatus may comprise detecting temperatures of refrigerant and water flowing into the water-refrigerant heat exchanger when the refrigerant discharged from the compressor flows into the water-refrigerant heat exchanger; and opening the second expansion device when temperature of water flowing into the water-refrigerant heat exchanger is higher than temperature of refrigerant flowing into the water-refrigerant heat exchanger, thereby increasing a flow path area of the expansion device. The opening of the second expansion device opens the second expansion device incrementally by a predetermined pulse at predetermined intervals, thereby reducing a sudden load imposed on the system.

The method according to the present disclosure further comprises measuring low-pressure of the compressor and determining whether the low-pressure of the compressor is less than or equal to predetermined pressure between the detecting of the temperature of the water-refrigerant heat exchanger and the opening of the second expansion device, wherein the opening of the second expansion device is performed when low-pressure of the compressor is less than or equal to predetermined pressure, and the second expansion device may be opened when a low-pressure drop phenomenon actually occurs.

The determining of whether low-pressure of the compressor is less than or equal to predetermined pressure may determine that low-pressure of the compressor is less than or equal to predetermined pressure when evaporation temperature of refrigerant according to measured low-pressure is less than or equal to a predetermined temperature, determine whether a low-pressure drop phenomenon has actually occurred through evaporation temperature of the refrigerant flowing into the compressor, and open the second expansion device.

The determining of whether low-pressure of the compressor is less than or equal to predetermined pressure may determine that low-pressure of the compressor is less than or equal to predetermined pressure when the difference between evaporation temperature of refrigerant according to measured low-pressure and temperature of outdoor air is larger than or equal to a predetermined temperature value, determine whether a low-pressure drop phenomenon has actually occurred through the difference between the evaporation temperature of the refrigerant flowing into the compressor and the temperature of outdoor air, and open the second expansion device.

The method according to the present disclosure further comprises closing the second expansion device when the temperature of water flowing into the water-refrigerant heat exchanger is lower than the temperature of the refrigerant flowing into the water-refrigerant heat exchanger when the refrigerant discharged from the compressor flows into the air-refrigerant heat exchanger, or the refrigerant discharged from the compressor flows into the water-refrigerant heat exchanger.

After the opening of the second expansion device, the method includes detecting temperatures of refrigerant and water flowing into the water-refrigerant heat exchanger; and closing the second expansion device if the temperature of water flowing into the water-refrigerant heat exchanger is lower than the temperature of refrigerant flowing into the water-refrigerant heat exchanger, and the method may close the second expansion device if condensation conditions are satisfied after the second expansion device is opened. The closing of the second expansion device may close the second expansion device incrementally by a predetermined pulse at predetermined intervals, thereby reducing a sudden load imposed on the system.

Specifics of other embodiments are provided in the detailed descriptions and drawings. According to at least one of the embodiments, due to the second expansion device connected to the first expansion device and opened if the temperature of water flowing into the first heat exchanger is higher than the temperature of refrigerant flowing into the first heat exchanger after heating operation is started, the refrigerant discharged from the compressor may circulate the cycle of the outdoor unit smoothly even when the refrigerant discharged from the compressor is not condensed in the first heat exchanger.

According to at least one of the embodiments, due to the second expansion device opened when the condensation conditions are not satisfied in the first heat exchanger, the phenomenon in which low-pressure of the compressor drops during the initial stage of heating operation may be improved, and the risk of compressor failure may be reduced. According to at least one of the embodiments, due to the second expansion device opened or closed incrementally, a sudden change in the pressure applied to the circulation cycle may be reduced. Through the process above, a load applied to the system may be reduced.

According to at least one of the embodiments, due to the second expansion device opened when the evaporation temperature of refrigerant flowing into the compressor is lower than or equal to a predetermined temperature, the second expansion device may be opened when the low-pressure drop phenomenon of the compressor actually occurs. Through the process above, unnecessary power consumption may be reduced, and efficiency of the heat supply apparatus may be improved.

According to at least one of the embodiments, due to the second expansion device opened when the difference between evaporation temperature of the refrigerant flowing into the compressor and the temperature of outdoor air is larger than or equal to a predetermined temperature, the second expansion device may be opened when the low-pressure drop phenomenon of the compressor actually occurs. Through the process above, unnecessary power consumption may be reduced, and efficiency of the heat supply apparatus may be improved.

According to at least one of the embodiments, due to the second expansion device in which the closing speed is greater than the opening speed, the second expansion device is quickly closed when the condensation conditions are satisfied, minimizing the flow of liquid refrigerant into the compressor.

According to at least one of the embodiments, the open flow path area of the second expansion device is formed to be larger than the flow path area of the first expansion device, thereby precisely controlling the degree of opening of the entire flow path of the expansion device.

The technical effects are not limited to the technical effects described above, and other technical effects not mentioned herein may be understood to those skilled in the art to which the present disclosure belongs from the description below.

Certain embodiments or other embodiments of the disclosure described above are not mutually exclusive or distinct from each other. Any or all elements of the embodiments of the disclosure described above may be combined with another or combined with each other in configuration or function.

For example, a configuration "A" described in one embodiment of the disclosure and the drawings and a configuration "B" described in another embodiment of the disclosure and the drawings may be combined with each other. Namely, although the combination between the configurations is not directly described, the combination is possible except in the case where it is described that the combination is impossible.

Although embodiments have been described with reference to a number of illustrative embodiments thereof, it should be understood that numerous other modifications and embodiments can be devised by those skilled in the art that will fall within the scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present invention.

Spatially relative terms, such as "lower", "upper" and the like, may be used herein for ease of description to describe the relationship of one element or feature to another element (s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative to the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments are described herein with reference to cross-section illustrations that are schematic illustrations of idealized embodiments (and intermediate structures). As such, variations from the shapes of the illustrations as a result, for example, of manufacturing techniques and/or tolerances, are to be expected. Thus, embodiments should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An apparatus comprising:

a compressor to compress refrigerant;

a first heat exchanger that is connected to the compressor through a refrigerant pipe and exchanges heat between refrigerant and water;

a second heat exchanger that is connected to the compressor through the refrigerant pipe and exchanges heat between refrigerant and air;

a first expansion device that is disposed in a section of the refrigerant pipe connecting the first heat exchanger and the second heat exchanger;

a second expansion device that is disposed in parallel to the first expansion device; and a controller that controls a degree of opening of the second expansion device, wherein refrigerant discharged from the compressor is sent to the first heat exchanger during a heating operation, and wherein the controller increases the degree of opening of the second expansion device, when the heating operation is started, in response to a temperature of water flowing into the first heat exchanger being greater than a temperature of refrigerant flowing into the first heat exchanger.

2. The apparatus of claim 1, wherein the controller increases the degree of opening of the second expansion device after starting the heating operation when the temperature of water flowing into the first heat exchanger is greater than the temperature of refrigerant flowing into the first heat exchanger by at least a predetermined temperature difference value.

3. The apparatus of claim 1, wherein the controller incrementally opens the second expansion device by a predetermined pulse amount at each of a plurality of predetermined intervals when increasing the degree of opening of the second expansion device.

4. The apparatus of claim 1, wherein the controller increases the degree of opening of the second expansion device after starting the heating operation when the temperature of water flowing into the first heat exchanger is greater than the temperature of refrigerant flowing into the first heat exchanger, and an evaporation temperature of refrigerant flowing into the compressor is less than a predetermined evaporation temperature value.

5. The apparatus of claim 1, wherein the controller increases the degree of opening of the second expansion device after starting the heating operation when the temperature of water flowing into the first heat exchanger is greater than the temperature of refrigerant flowing into the first heat exchanger, and a difference between an evaporation temperature of refrigerant flowing into the compressor and a temperature of air at the second heat exchanger is more than a predetermined temperature difference value.

6. The apparatus of claim 1, wherein the controller reduces the degree of opening of the second expansion device when the temperature of water flowing into the first heat exchanger becomes less than the temperature of refrigerant flowing into the first heat exchanger after increasing the degree of opening of the second expansion device.

7. The apparatus of claim 6, wherein the controller incrementally closes the second expansion device by a predetermined pulse closing amounts at each of a plurality of predetermined closing intervals when reducing the degree of opening of the second expansion device.

8. The apparatus of claim 7, wherein the controller opens the second expansion device incrementally by a predetermined pulse opening amount at each of a plurality of predetermined opening intervals when increasing the degree of opening of the second expansion device, and a closing speed of the second expansion device is greater than an opening speed of the second expansion device.

9. The apparatus of claim 1, wherein refrigerant discharged from the compressor is sent to the second heat exchanger during a cooling operation, and wherein the controller reduces the degree of opening of the second expansion device when the cooling operation is started.

10. The apparatus of claim 1, wherein an open flow path area of the second expansion device is larger than an open flow path area of the first expansion device.

11. A method for controlling an apparatus comprising a compressor, a water-refrigerant heat exchanger, an air-refrigerant heat exchanger, a first expansion device disposed between the water-refrigerant heat exchanger and the air-refrigerant heat exchanger, and a second expansion device provided in parallel to the first expansion device, the method comprising:

determining temperatures of refrigerant and water flowing into the water-refrigerant heat exchanger when refrigerant discharged from the compressor flows into the water-refrigerant heat exchanger; and increasing a degree of opening of the second expansion device in response to the temperature of water flowing into the water-refrigerant heat exchanger being greater than the temperature of refrigerant flowing into the water-refrigerant heat exchanger from the compressor.

12. The method of claim 11, wherein the increasing of the degree of opening of the second expansion device includes opening the second expansion device incrementally by a predetermined pulse amount at each of a plurality of predetermined opening intervals.

13. The method of claim 11, further comprising:

measuring a-pressure of refrigerant input into the compressor; and determining whether the pressure of refrigerant input into the compressor is less than or equal to predetermined pressure value, wherein the increasing of the degree of opening of the second expansion device is performed further in response to determining that the pressure of refrigerant input into the compressor is less than or equal to the predetermined pressure value.

14. The method of claim 13, wherein the determining of whether the pressure of refrigerant input into the compressor is less than or equal to the predetermined pressure value includes:

determining an evaporation temperature of refrigerant input into the compressor according to the measured pressure of refrigerant input into the compressor; and determining that the pressure of refrigerant input into the compressor is less than or equal to the predetermined pressure value when the evaporation temperature of refrigerant input into the compressor is less than or equal to a predetermined evaporation temperature value.

15. The method of claim 14, wherein the determining of whether the pressure of refrigerant input into the compressor is less than or equal to the predetermined pressure value includes:

determining that pressure of refrigerant input into the compressor is less than or equal to the predetermined pressure value when a difference between the evaporation temperature of refrigerant input into the compressor and a temperature of air at the second heat exchanger is greater than or equal to a predetermined temperature difference value.

16. The method of claim 11, further comprising closing the second expansion device when:

the temperature of water flowing into the water-refrigerant heat exchanger is less than the temperature of refrigerant flowing into the water-refrigerant heat exchanger while refrigerant discharged from the compressor flows into the air-refrigerant heat exchanger, or refrigerant discharged from the compressor flows into the water-refrigerant heat exchanger and not the air-refrigerant heat exchanger.

17. The method of claim 11, further comprising:

detecting the temperatures of refrigerant and water flowing into the water-refrigerant heat exchanger after the increasing of the degree of opening of the second expansion device; and reducing of the degree of opening of the second expansion device when the temperature of water flowing into the water-refrigerant heat exchanger is less than the temperature of refrigerant flowing into the water-refrigerant heat exchanger.

18. The method of claim 17, wherein the reducing of the degree of opening of the second expansion device includes incrementally closing the second expansion device by a predetermined pulse amount at each of a plurality of predetermined intervals.

19. An apparatus comprising:

a compressor that compresses refrigerant;

a first heat exchanger that is connected to the compressor and exchanges heat between refrigerant and water;

a second heat exchanger that is connected to the compressor and exchanges heat between refrigerant and air;

a first expansion device disposed in a first refrigerant pipe connecting the first heat exchanger and the second heat exchanger;

a second expansion device disposed in a second first refrigerant pipe connecting the first heat exchanger and the second heat exchanger, the second refrigerant pipe extending parallel to the first refrigerant pipe; and a controller that controls a degree of opening of the second expansion device, wherein refrigerant discharged from the compressor is sent to the first heat exchanger during a heating operation, and wherein the controller increases the degree of opening of the second expansion device, when the heating operation is started, in response to a temperature of water flowing into the first heat exchanger being greater than or equal to a temperature of water flowing out from the first heat exchanger by at least a predetermined value.

20. The apparatus of claim 19, wherein the controller reduces the degree of opening of the second expansion device after increasing the degree of opening of the second expansion device when the temperature of water flowing into the first heat exchanger is not greater than or equal to the temperature of water flowing out from the first heat exchanger by at least the predetermined value.

* * * * *